US010458181B2

(12) United States Patent
Smith

(10) Patent No.: US 10,458,181 B2
(45) Date of Patent: Oct. 29, 2019

(54) BARRIER

(71) Applicant: A-FAX LIMITED, Elland, West Yorkshire (GB)

(72) Inventor: Luke Smith, Halifax (GB)

(73) Assignee: A-FAX LIMITED, Elland, West Yorkshire (GB)

( * ) Notice: Subject to any disclaimer, the term of this patent is extended or adjusted under 35 U.S.C. 154(b) by 24 days.

(21) Appl. No.: 15/316,553

(22) PCT Filed: Jun. 5, 2015

(86) PCT No.: PCT/GB2015/051645

§ 371 (c)(1),
(2) Date: Dec. 6, 2016

(87) PCT Pub. No.: WO2015/185939

PCT Pub. Date: Dec. 10, 2015

(65) Prior Publication Data

US 2017/0159338 A1 Jun. 8, 2017

(30) Foreign Application Priority Data

Jun. 6, 2014 (GB) ..... 1410099.4

(51) Int. Cl.
*E06B 11/02* (2006.01)
*E06B 11/00* (2006.01)

(52) U.S. Cl.
CPC ..... *E06B 11/022* (2013.01); *E06B 11/00* (2013.01); *E06B 11/02* (2013.01); *E05Y 2900/11* (2013.01); *E06B 11/025* (2013.01)

(58) Field of Classification Search
CPC ..... E06B 11/022; E04F 11/1834
See application file for complete search history.

(56) References Cited

U.S. PATENT DOCUMENTS 3,656,788 A * 4/1972 Emery ..... E05C 19/003 292/148
4,176,868 A 12/1979 Cole
(Continued)

FOREIGN PATENT DOCUMENTS

CN 201794037 U 4/2011
CN 204163010 U 2/2015
(Continued)

OTHER PUBLICATIONS

Nov. 17, 2015 Search Report issued in British Patent Application No. 1410099.4.

(Continued)

*Primary Examiner* — Catherine A Kelly
(74) *Attorney, Agent, or Firm* — Oliff PLC

(57) ABSTRACT

There is provided a barrier and a method of opening and closing a barrier. The barrier including a first arm moveable about a first support, a second arm moveable about a second support and at least one coupling. The first and second supports are spaced across an opening and the barrier is arranged between an open and closed position, such that in the closed position, the arms are arranged in combination to traverse the opening. The barrier is further arranged in a locked position, such that the coupling is slidably coupled to the first and second arms. The barrier improves the safety of loading bay areas in order to allow the efficient transfer of goods on freight transportation vehicles.

13 Claims, 3 Drawing Sheets

(56) References Cited

U.S. PATENT DOCUMENTS

| | | | | | |
|---|---|---|---|---|---|
| 4,545,150 | A * | 10/1985 | Williams | ..... | E05B 65/0007 292/148 |
| 8,928,458 | B2 * | 1/2015 | Fortin | ..... | E06B 11/022 340/5.7 |
| 2015/0308179 | A1 * | 10/2015 | Mercier | ..... | E05F 15/70 49/30 |

FOREIGN PATENT DOCUMENTS

| | | | | | |
|---|---|---|---|---|---|
| DE | 3205486 | A1 | | 10/1983 | |
| DE | 02 12 048 | U1 | | 12/1992 | |
| GB | 1 293 623 | A | | 10/1972 | |
| GB | 1293623 | A | * | 10/1972 | ..... E06B 11/00 |
| GB | 2454355 | A | | 5/2009 | |
| JP | 2002-121717 | A | | 4/2002 | |
| JP | 2005-194874 | A | | 7/2005 | |
| JP | 2006-291591 | A | | 10/2006 | |

OTHER PUBLICATIONS

Aug. 14, 2015 Written Opinion issued in International Patent Application No. PCT/GB2015/051645.
Aug. 14, 2015 Search Report issued in International Patent Application No. PCT/GB2015/051645.

* cited by examiner

BARRIER

FIELD OF INVENTION

The invention relates to a barrier and a method of opening and closing a barrier, and in particular, but not exclusively, to a barrier for use in loading bays.

BACKGROUND TO THE INVENTION

When loading goods to and from a freight transportation vehicle, such as a lorry, a forklift truck is commonly used. Usually, the forklift truck is driven along a loading bay and up to or onto the lorry, as required. The loading bay is therefore usually raised above the ground so that the loading bay and the vehicle are level in order to allow the smooth transfer of goods. However, a raised loading bay is hazardous when not in use. Any personnel operating within the loading bay area, in or out of a forklift truck, may be unaware of the edge of the loading bay. Overstepping the edge is likely to cause injury to the personnel and/or damage to the forklift truck. Furthermore, any forklift trucks travelling at speed may not be able to stop in time before reaching the edge of the loading bay. Permanent barriers are sometimes used to prevent injury or damage caused by overstepping the edge. However, these barriers are usually fixed in place and limit access from the forklift truck and to the lorry. Fixed barriers increase the loading time and require further manual intervention in order to load the lorry.

There is a need to improve the safety and practicality of loading bays so that loading bays are safe when not in use but can be used efficiently when loading freight transportation vehicles.

It is an object of the present invention to attempt to overcome at least one of the above or other identified problems.

It is a further object of the present invention to reduce the risk of damage to machinery operating in loading bays whilst providing the convenience of good access. It is a further object to provide a barrier for temporarily opening a barrier that is easily manufactured and looks and functions like a barrier when closed.

SUMMARY OF THE INVENTION

According to the present invention, there is provided a barrier and a method of opening and closing a barrier as set forth in the appended claims. Other features of the invention will be apparent from the dependent claims and the description which follows.

According to an exemplary embodiment, a barrier is provided. The barrier is particularly suited for loading bays, raised platforms, overhanging extensions, and the like, although the barrier may not be limited to such applications. The barrier comprises a first arm and a second arm, each arm being moveable about a first support and a second support, respectively. The barrier further comprises at least one coupling. The first and second supports are arranged to be spaced across an opening. The barrier is arranged between an open position and a closed position. In the closed position, the first arm and second arm are arranged in combination to traverse the opening. This means that when the arms are arranged in the closed position, the combination of the first and second arms substantially block the opening. The barrier is further arranged in a locked position, such that each coupling is slidably coupled to the first and second arms. Each coupling allows the barrier to be easily locked and unlocked by sliding each coupling away from locked position. Each coupling reinforces the strength of the barrier because each coupling provides a subsequent layer to each arm when in the locked position. This layering helps to strengthen the barrier and provide for better absorption of any impact with the barrier is in use. Each coupling can be easily replaced if damaged because each coupling is slidably attached to the barrier and therefore not fixed to the barrier.

Preferably, the arms have a similar external shape. The external shape of each coupling is preferably similar to the arms, if not the same. For instance, the arms may be cylindrical and the coupling may also be cylindrical. Typically the arms and coupling are extruded to have a constant cross section. The extrusions are suitably hollow with a constant wall thickness. The shape of the arms or each coupling may be varied to improve the contact area of peripheral objects on impact. Furthermore, each coupling may be made from a material that has improved deflection qualities. For instance the arms, coupling and support may be formed from extruded plastic.

Preferably, at least one coupling is hollow. A hollow coupling allows the arms to be partially enclosed. The coupling may be thin walled. However, the coupling may have substantially the same thickness as either one, or both of the arms. Preferably, the coupling is disposed on the outside of the arms when the barrier is arranged in the locked position. The coupling may partially cover the circumference of the arm or may fully cover the circumference. Further, the coupling may have cut-out portions or slots. Furthermore, the coupling may be multi-layered. Different layers may have different deflection qualities. For instance, an outer layer may easily deflect in order to cushion an impact, whereas an inner layer may deflect less to provide strength.

In the exemplary embodiments, the coupling is a sleeve. The sleeve is fitted to one of the arms so as to be able to slide relative to said arm. When the arms are closed, the arms substantially align so that the sleeve can be slid to cover the other of the arms and to substantially lock the two arms to form a single length of barrier. Advantageously, the barrier is formed using similar components to known barriers so that when closed, the barrier has an appearance of a known barrier. Typically, a central axis of the sleeve is coincident with a central axis of the arm.

Preferably, each arm comprises at least one hollow section. For instance, each arm may be tubular. A hollow arm helps to reduce the mass of each arm and therefore helps to remove unnecessary forces distributed through the barrier. The hollow section may accommodate the coupling, so that the coupling is disposed on the inside of the arms when arranged in the locked position. The coupling and arm arrangement may be a piston and cylinder arrangement. When in the open position, the coupling is recessed into the arm. The coupling may be solid in order to improve the ability to absorb an impact. The coupling may be composed of several layers, each layer offering improved strength or deflection qualities. For instance, the coupling may be composed of two or three layers. Each layer may have a different density in order to improve absorption but prevent plastic distortion. For instance, an outer layer may be more easily distorted on impact and therefore have absorption qualities, as opposed to an inner layer or core layer. The inner core may be solid to improve strength.

Preferably, the barrier further comprises a first retaining means. The first retaining means may be arranged to impede movement of each coupling when arranged in the locked position. This helps to provide positive engagement and clearly identify how far the coupling needs to slide to be sufficiently locked.

Preferably, the barrier further comprises a second retaining means. The second retaining means may be arranged to impede movement of each coupling when not arranged in the locked position. This helps to provide positive engagement so that the barrier can be quickly opened. The second retaining means also helps to keep the coupling a set distance on the arm and help retain the coupling when in the open position.

Preferably, at least one of the first or second retaining means is located on each coupling. This allows the retaining means to be concealed by the coupling.

Preferably, the first and second retaining means are located on the same arm. This helps to retain the coupling on one arm so that the coupling is not easily removed from the barrier.

Preferably, the first and second retaining means are located on different arms. This allows each retaining means to be sedately inspected for damage or replaced if necessary. It also allows the coupling to be slidably removed from the barrier if necessary.

Preferably, at least one of the first or second retaining means is a projection. Such a projection may exist around the whole circumference of either the coupling or the first or second arm. The projection may be on the underside of the barrier to improve maintenance access when the barrier is in the open position and to further prevent damage when the barrier is in the closed or locked position. More than one projection may be used to achieve the impeding function of the first or second retaining means. Either or both the first or second retaining means may be a ramped section whereby a tightening force exists. Either or both the first or second retaining means may be removable, such as a pin, a bolt or a screw. Either or both the first or second retaining means may further include a slot or recess so that the projection can be concealed when the barrier is in use.

Preferably, the barrier further comprises a counterweight. The counterweight may be arranged on the first and second arm whereby the counterweight is outside the opening when the barrier is arranged in the closed position. The counterweight is a counterbalance which may be set according to the mass of the arm. The counterweight may be variable. The counterweight may be set higher to accommodate the retention of the coupling on one arm. The counterweight may be removable which helps to improve variability and allow the effect of the counterbalance to be effected. The counterweights help to reduce the footprint of the first and second supports because the moments generated by the arms when in the closed position are dramatically reduced. Furthermore, the effort required to raise the arms of the barrier is reduced.

The arms may be arranged to move in a side-to-side direction. That is, the arms pivot relative to the supports about a substantially vertical axis. Here, when the supports are elongate along an axis, the pivot is provided parallel to said axis. When in the open position, the arms act as a further barrier to prevent side impacts to personnel or machines operating in the loading bay area. Sideways movement also protect the user because the user can stand behind the barrier when opening the barrier. Such side-to-side movement is also advantageous when the height is restricted.

In the exemplary embodiments, the arms are arranged to move in an up-and-down direction. That is, the arms pivot relative to the supports about a substantially horizontal axis. Here, when the supports are elongate along an axis, the pivot is provided orthogonal to said axis. This allows the arms to be easily stowed within side walls of a building where the barrier is installed when arranged in the open position. This allows the barrier to maximise access to the loading bay area from in and around the opening. Up-and-down movement is advantageous when the loading area is more confined.

Preferably, the arms rotate relative to the supports about a central shaft. However, the central shaft may be located on the respective arms and the central shaft may thus rotate about the supports. Bearings may be provided on either the arm or supports as required. However, the arms may pivot through a system of linkage arms in order to provide a varied direction of travel of the arms. For instance, the arms of the barrier may be moved by a four-bar linkage system.

Preferably, the barrier can be arranged toward the open position by manually operating the barrier. However, a motor may also be used to power the barrier.

Preferably, the arms are substantially collinear when arranged in the closed position. This allows the coupling to be easily slid on to the opposed arm and helps the barrier to take up less floor space when in the closed position.

A distance of traverse of each arm, that is, the distance that each arm extends into and across the opening when in the closed position, may be unequal. This allows a central gap between first and second supports to be off-centre. This may be beneficial when the access varies on either side of the barrier. An unequal distance of traverse allows one arm to act as a gate for personnel to use temporarily when the whole barrier does not need to be in the open position. An unequal distance of traverse may be achieved by a variable length of first or second arm. For instance, either or both of the first or second arms may be telescopic so that the length of each arm can be varied accordingly. Furthermore, each arm may have modular pieces so that each arm can be extended or retracted as required to achieve an off-centre gap or an unequal distance of traverse across the opening.

The barrier may further include a second locking member used to lock the first and second arms when in the open position. Each locking member may be located on each arm or each respective support. Two locking members may be provided on each arm or support to improve the locking ability. The locking members may be pins that protrude across or from each arm or toward each respective support or arm in order to prevent rotation of each arm and hold the arm in a further locked position. The locking members may be spring loaded in order to retract when not in use. The locking members may be pins that are positioned manually. Furthermore, the locking members may be bolted or screwed into position.

Preferably, the arms, coupling and supports of the barrier are extruded. For instance, each arm or coupling may be extruded. Each extrusion may be a plastic extrusion.

The exemplary embodiments show one coupling. However, it will be appreciated that multiple couplings may be used. For instance, two or more couplings may be used. The advantage of two or more couplings is that the coupling arrangement is reinforced in order to better absorb any impact on the barrier when in use.

According to a further exemplary embodiment, a method of opening and closing a barrier is provided. The method comprises moving a first arm about a first support from an open position and moving a second arm about a second support from an open position. The first and second arms are moved into a closed position by arranging the arms in combination to traverse an opening. The opening is spaced across the first and second supports to allow access through the barrier when the arms are open. Finally, the method comprises the step of locking the barrier in a locked position by slidably coupling at least one coupling to the first and second arms. This method allows the quick transformation of a barrier blocking an opening to provide access through the barrier. Each slidable coupling provides a further layer of reinforcement to the arms in order to improve the ability of the arms to absorb an impact. The contact area of each coupling is increased because each coupling is spread out over both the first and second arms when in the locked position.

Preferably, the method further comprises the step of impeding each coupling against a first retaining means. This provides positive alignment of each coupling when in the locked position. The method may further include the step of securing each coupling to the first retaining means using a bolt, a pin or a screw. Therefore, the method may therefore include pinning, bolting or screwing the first retaining means. Furthermore, the first retaining means may be removed as and when required.

Preferably, the method further comprises the step of retracting the coupling towards and abutting a second retaining means when moving from the locked position to the closed position. This provides positive alignment of each coupling when in the closed position. The method may further include the step of securing each coupling to the second retaining means using a bolt, a pin or a screw. Therefore, the method may therefore include pinning, bolting or screwing in the second retaining means. Furthermore, the second retaining means may be removed as and when required.

Preferably, each coupling is retained by one arm when the barrier moves to and from an open position and closed position. This advantageously allows the first retaining means to be concealed by the arm.

Preferably, a counterweight is arranged on the first and second arm to assist the movement of the first and second arms. This provides the advantage that the movement of the arms can be controlled and smooth to provide improved safety for the user.

Preferably, the first and second arms are moved in a side-to-side direction when moving to and from the open position and closed position. This allows the barrier to be installed in areas where the height is restricted.

Preferably, the first and second arms are moved in an up-and-down direction when moving to and from the open position and closed position. This allows the arms to not impede the area around the barrier. It also improves the ability to inspect the arms when in the open position.

Preferably, the movement of the first and second arms may be motorised and controlled by a control means, such as a motor. A gearing system may also be used as required. Furthermore, the movement of the first and second arms may be non-linear and defined by a linkage system.

BRIEF DESCRIPTION OF THE DRAWINGS

For a better understanding of the invention, and to show how embodiments of the same may be carried into effect, reference will now be made, by way of example, to the accompanying diagrammatic drawings in which.

DETAILED DESCRIPTION OF THE INVENTION

Figure 1:
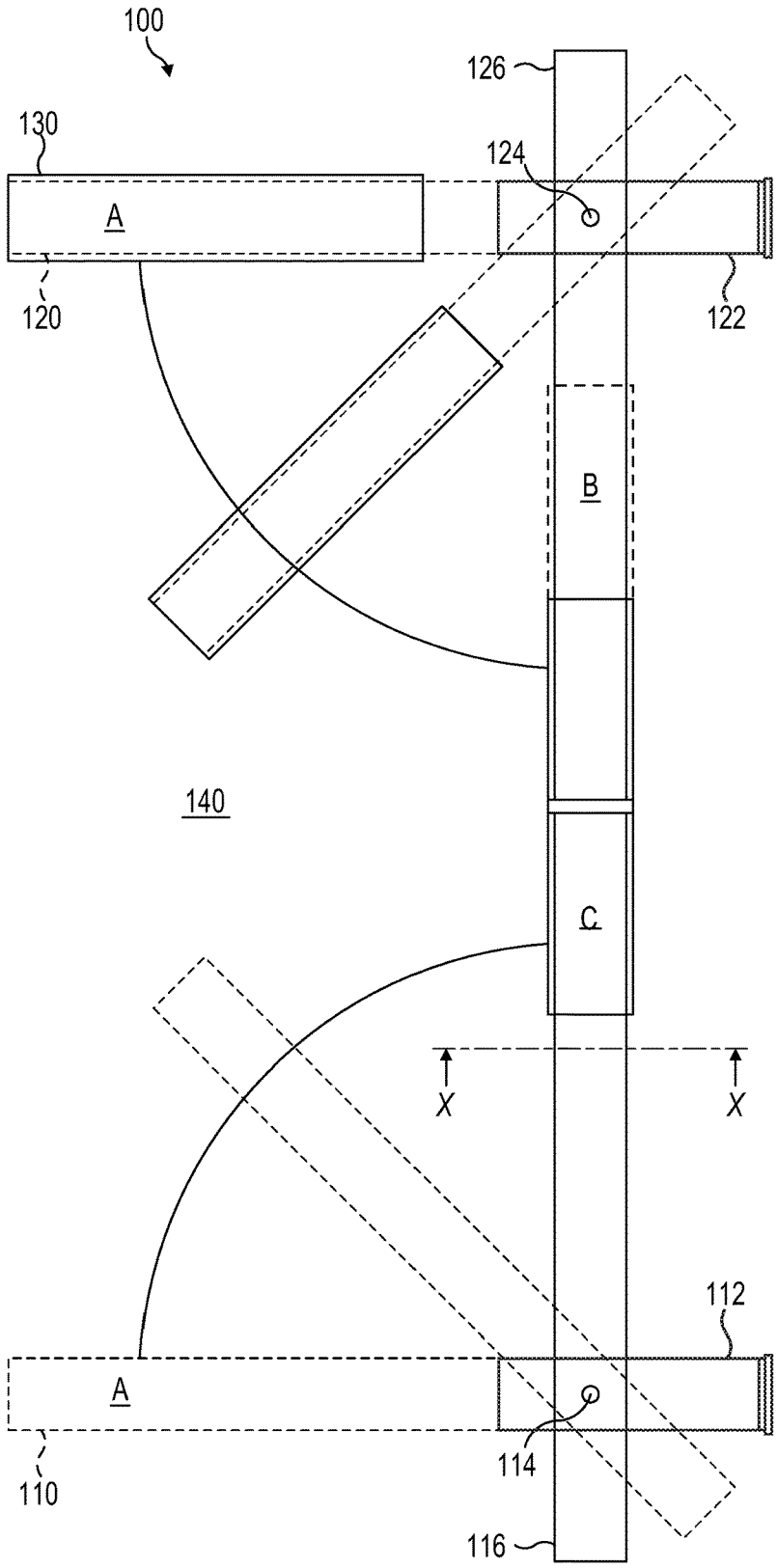
FIG. 1 is a front view of a barrier showing the full range of movement from the open position to the closed position and finally to the locked position.

Referring to FIG. 1, a barrier 100 is shown. The barrier 100 comprises a first arm 110 moveable about a first support 112 by means of rotation. A central shaft 114 supports the first arm 110 and allows the first arm 110 to rotate. Although not shown, bearings are provided on the first support 112 to promote smooth rotation of the first arm 110. A second arm 120 is also shown. The second arm 120 is also rotatable about a corresponding second support 122 and suitable bearings are provided. The barrier 100 further comprises a coupling 130 mounted on the second arm 120 whilst in an open position A. The first 112 and second 122 supports are spaced across an opening 140. The barrier 100 is moveably arranged between the open position A and closed position B. In the open position A, the arms 110,120 are upwardly facing and rest in a substantially vertical orientation. This is the limit of rotation about the central shaft 114. In the closed position B, the arms 110,120 are rotated in a downwards direction to be arranged in combination to traverse the opening 140. The range of movement is balanced by counterweights 116,126 arranged in each arm 110,112 in order to allow the rotation of the barrier 100 to be controlled and smooth and reduce any bending moments whilst generated in the closed B position. This helps to give an assured quality to the rotation of the arms 110,120 and helps to avoid acceleration of the arms 110,120 when moving towards or away from the closed position B. The barrier 100 is further arranged in a locked position C, whereby the coupling 130 is slidably coupled to the first 110 and second 120 arms. The coupling 130 acts like a sleeve. The coupling 130 is hollow and arranged on the exterior surface of the arms 110,120. When in the open position A, the coupling 130 is attached to the second arm 120. Accordingly, the counterweight 126 arranged on the second arm 120 is designed to accommodate the additional weight of the coupling 130 carried by the second arm 120 in order to maintain equal ease of lifting to the first arm 110.

Figure 2:
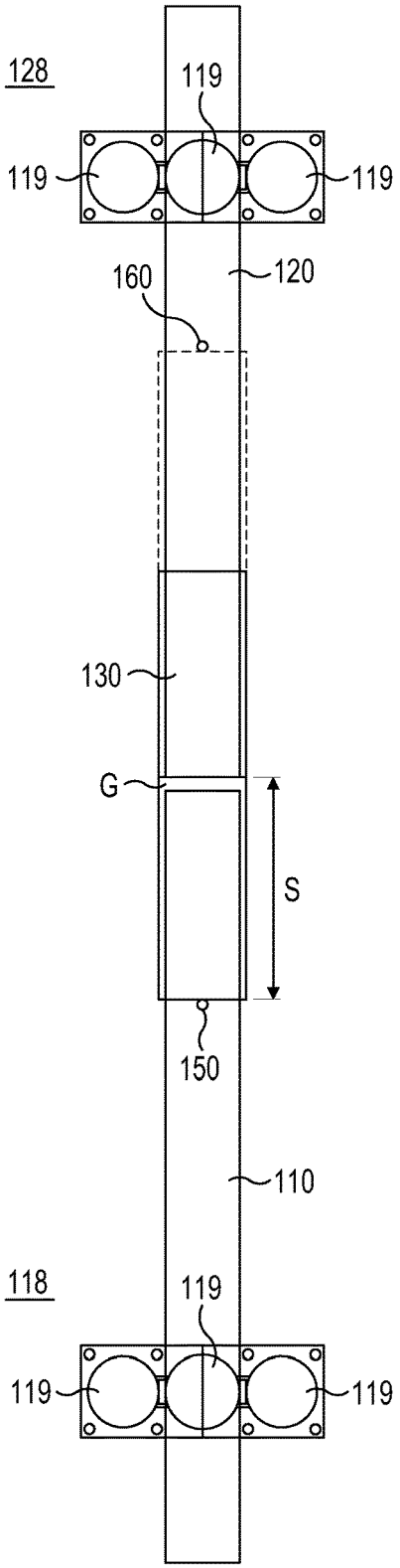
FIG. 2 is a bottom view showing the underside of the barrier in the locked position (the dashed lines of the coupling show the closed position)

Further referring to FIG. 2, a first retaining means 150 is disposed on the first arm 110. The first retaining means 150 is shown as a protrusion which impedes movement of the coupling 130 whilst the barrier 100 is in the locked position C. The first retaining means 150 is shown on the underside of the first arm 110 so that when in the closed B and locked C positions, the first retaining means 150 is not exposed and is therefore better protected from damage. Furthermore, a second retaining means 160 is shown on the second arm 120, once again on the underside, for similar reasons. A further benefit of locating the first and second retaining means 150,160 on the underside of the first and second arms 110,120 is that visual inspection and repair can be easily established when the barrier 100 is in the open position A. This allows the retaining means 150,160 to be easily assessed at a comfortable, high level, as opposed to an awkward, low level.

The coupling 130 is shown to travel a distance S when sliding the coupling 130 to operate the barrier 100 from the closed position B (as shown by the dashed lines) to the locked position C. Distance S may be at least 25% or at least 30% of the length of the arm from the distal end to the support. In the locked position C, the coupling 100 abuts the first retaining means 150 on the first arm 110 and partially covers both arms 110,120 in order to bridge the gap G between the arms 110,120. The coupling 130 can be used to partially lock the barrier 100 by sliding the coupling 130 partly along the first arm 110 but not up to the first retaining means 150. However, the effectiveness of the barrier 100 to lock the arms 110,120 and prevent distortion of the barrier 100 on impact is reduced. When the coupling 130 is retracted, the coupling abuts the second retaining means 160 on the second arm 120. This helps to provide positive feedback so that the user knows that the barrier 100 is safe to open.

The first and second supports 112,122 are provided on a first and second base 118,128 respectively. Several bolts 119 are shown that are used to secure the first and second bases 118,128 to the ground. The first and second base 118,128 accommodates the first and second supports 112,122 in that the first and second supports 112,122 are stable and secure. Although not shown, the bolts 119 are suitably long to prevent lateral movement of the first and second base 118,128.

Figure 3:
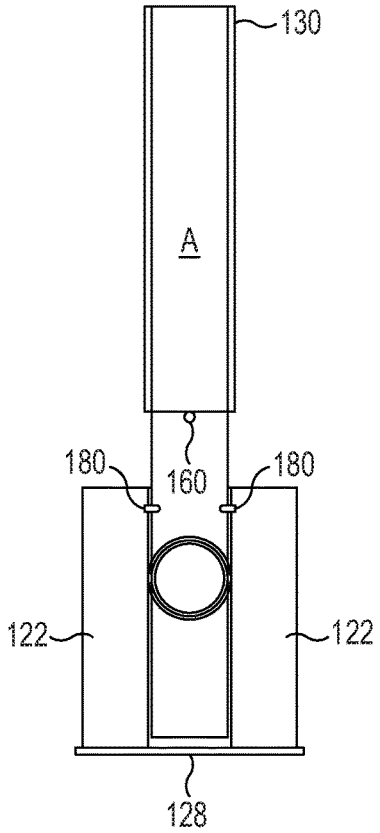
FIG. 3 is a cross-sectional side view of the barrier showing the view towards the second support.

Further referring to FIG. 3, the barrier 100 is shown in the open position A. In this upright position, the second arm 120 is shown to be substantially vertical and the coupling 130 is prevented from sliding along the second arm 120 by the second retaining means 160. The coupling 130 is shown to fully cover the circumference of the second arm 120 whilst in the open position A and helps to protect the integrity of the second arm 120. The second arm 120 is locked in the open position A by a locking member 180. Two locking members 180 are shown as pins that protrude across the second arm 120 and prevent rotation of the second arm 120. Although not shown, these locking members 180 are spring loaded so that when the second arm 120 moves past the locking members 180 and towards the open position A, the locking members 180 retract and then spring outwardly locking the second arm 120 in place. The locking members 180 are manually depressed to allow the second arm 120 to be lowered towards the closed and locked positions B,C.

The second support 122 is shown to comprise two support members either side of the arm. This allows the central shaft 124 to be fully supported in order to carry the load of the second arm 120 and coupling 130. The two support members allow the load to be distributed towards the base 128 which is shown to be relatively wide compared to one support member. This helps to reduce the pressure on the ground in order to prevent localised sinking or cracking.

It is appreciated from the discussion of the second arm 120 and the corresponding features of the second arm 120 as shown in FIG. 3 that similar technical features and variations can be equally applied to the first arm 110 and the corresponding features of the first arm 120.

Figure 4:
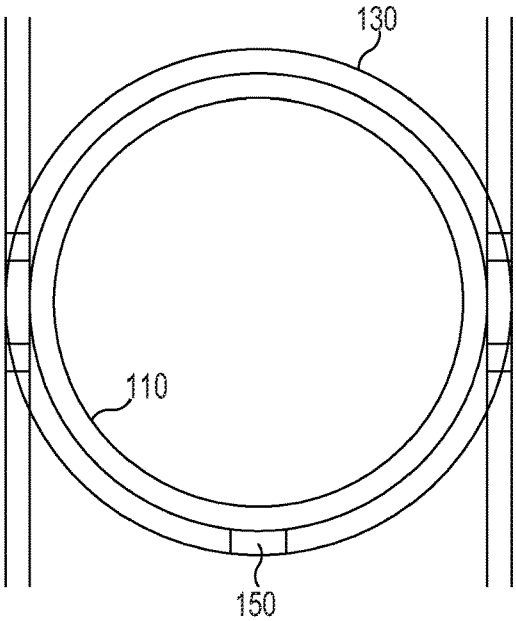
FIG. 4 is an enlarged view of FIG. 3 showing the coupling and first retaining means arranged on the first arm.

Finally referring to FIG. 4, an enlarged view of the cross-section through the first arm 110 of the barrier 100 is shown. This view shows the coupling 130 abutting the first retaining means 150 in the locked position C. The coupling 130 is a hollow member that wraps around the first and second arms 110,120 when in the locked position C. The coupling 130 and the first arm 110 are substantially circular. The coupling 130 and the first arm 110 are produced from an extrusion process and form an extruded plastic. The first arm 110 is also shown as a hollow member in order to allow the first arm 110 to have reduced weight so that the respective counterweight 126 can have reduced mass and thus save material and cost. The first retaining means 150 is shown to have at least the same thickness as the coupling 130.

The industrial application of the invention will be readily appreciated from the description herein. In particular, the barrier is capable of being made and used in industry, especially in the designated loading bays or 'goods in' or 'goods out' areas of a manufacturing site.

Although preferred embodiment(s) of the present invention have been shown and described, it will be appreciated by those skilled in the art that changes may be made without departing from the scope of the invention as defined in the claims.

The invention claimed is:

1. An impact barrier comprising:
- a first support;
- a second support;
- a first arm moveable about the first support to rotate about a substantially horizontal pivot axis;
- a second arm moveable about the second support to rotate about a substantially horizontal pivot axis;
- a coupling mounted to the first arm and arranged to slide relative to and along the first arm and the second arm, wherein:
  - the first and second supports are spaced across an opening, and the impact barrier is arranged between an open position and a closed position, such that in the closed position, the first and second arms are arranged in combination to traverse the opening; and
  - when in the closed position, the coupling is arranged to slide along and relative to the first and second arms, by a distance of at least 25% of a length of one of the first arm and the second arm, from a first position in which the coupling is mounted on only the first arm to a second position in which the coupling is mounted on both the first and second arms; and
- a projection provided on the second arm, the projection arranged to abut the coupling to impede movement of the coupling along the second arm beyond the second position when the impact barrier is arranged in the closed position.

2. The impact barrier as claimed in claim 1, wherein
- the coupling is hollow and is disposed on an outside of the first and second arms.

3. The impact barrier as claimed in claim 1, wherein:
- each of the first and second arms comprises a hollow section to accommodate the coupling; and
- the coupling is disposed on an inside of the first and second arms.

4. The impact barrier as claimed in claim 1, further comprising:
- another projection provided on the first arm, the other projection arranged to abut the coupling to impede movement of the coupling when the impact barrier is arranged in the first position.

5. The impact barrier as claimed in claim 1, wherein
- a slot or a recess is provided on the coupling.

6. The impact barrier as claimed in claim 1, wherein
- the projection comprises a plurality of elements that are located on the second arm.

7. The impact barrier as claimed in claim 4, wherein
- each of the projection and the other projection comprises a plurality of elements.

8. The impact barrier as claimed in claim 1, further comprising:
- a counterweight arranged on each of the first arm and the second arm such that the counterweight is outside the opening when the impact barrier is arranged in the closed position.

9. A method of opening and closing an impact barrier comprising the steps of:

moving a first arm about a first support to rotate about a substantially horizontal pivot axis;

moving a second arm about a second support to rotate about a substantially horizontal pivot axis, wherein the first and second supports are spaced across an opening, and the impact barrier is arranged between an open position and a closed position, such that in the closed position, the first and second arms are arranged in combination to traverse the opening;

arranging the impact barrier into the closed position by arranging the first and second arms in combination to traverse the opening;

sliding a coupling, by a distance of at least 25% of a length of one of the first arm and the second arm, from a first position in which the coupling is mounted on only the first arm to a second position in which the coupling is mounted on both the first arm and the second arm; and impeding movement of the coupling along the second arm beyond the second position by a projection provided on the second arm that abuts the coupling when the impact barrier is arranged in the closed position.

10. The method as claimed in claim 9, further comprising:

the step of impeding movement of the coupling against another projection provided on the first arm when the impact barrier is arranged in the open position.

11. The method as claimed in claim 9, further comprising:

the step of retracting the coupling towards and abutting another projection provided on the first arm when moving the coupling from the second position to the first position.

12. The method as claimed in claim 9, wherein the coupling is retained by only the first arm when the impact barrier moves to and from the open position and the closed position.

13. The method as claimed in claim 9, wherein a counterweight is arranged on each of the first arm and the second arm to assist the movement of the first and second arms.

* * * * *